US005842367A

United States Patent [19]

Rohde

[11] Patent Number: 5,842,367

[45] Date of Patent: Dec. 1, 1998

[54] ROLLING MILL TRAIN SYSTEM FOR THE MANUFACTURE OF HOT ROLLED WIDE STRIP

[75] Inventor: Wolfgang Rohde, Dormagen, Germany

[73] Assignee: SMS Schloemann-Siegmag Aktiengesellschaft, Dusseldorf, Germany

[21] Appl. No.: 824,378

[22] Filed: Mar. 26, 1997

Related U.S. Application Data

[63] Continuation-in-part of Ser. No. 161,996, Dec. 2, 1993, abandoned, which is a continuation of Ser. No. 934,990, Aug. 25, 1992, abandoned.

[30] Foreign Application Priority Data

Sep. 9, 1991 [DE] Germany ..... 41 29 749.0

[51] Int. Cl.[6] ..... B21B 27/06; B21B 41/00

[52] U.S. Cl. ..... 72/202; 72/227

[58] Field of Search ..... 72/200, 201, 202, 72/203, 224, 226, 227, 229, 234, 39

[56] References Cited

U.S. PATENT DOCUMENTS

| | | | |
|---|---|---|---|
| 3,119,606 | 1/1964 | Suydam et al. | 72/200 |
| 3,149,520 | 9/1964 | Fish et al. | 72/203 |
| 3,345,841 | 10/1967 | Phelan et al. | 72/39 |
| 3,411,332 | 11/1968 | Cook | 72/202 |
| 4,407,486 | 10/1983 | Mills et al. | 72/200 |

*Primary Examiner*—Joseph J. Hail, III
*Assistant Examiner*—Rodney Butler
*Attorney, Agent, or Firm*—Anderson, Kill & Olick, P.C.

[57] ABSTRACT

A method of producing a hot rolling wide strip in a rolling mill train, in which the strip leaving the breakdown train is treated in a roller hearth furnace, which is located downstream of the breakdown train and upstream of the cropping shears, to equalize the temperature along the entire strip length and, after leaving the roller hearth furnace is delivered at a constant velocity to the first stand of the finishing train, and is further finish-rolled in the finishing train operating at a constant velocity.

5 Claims, 1 Drawing Sheet

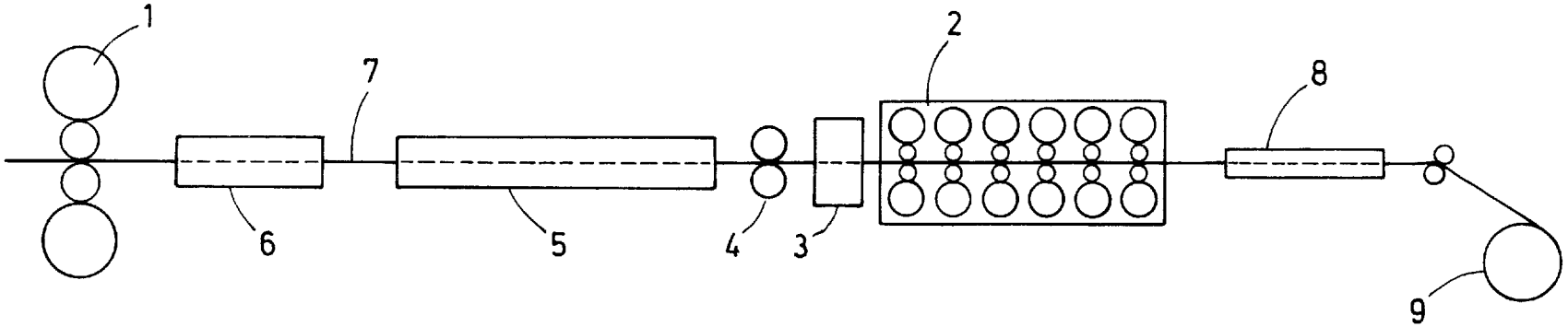
1
6
7
5
4
3
2
8
9

ROLLING MILL TRAIN SYSTEM FOR THE MANUFACTURE OF HOT ROLLED WIDE STRIP

RELATED APPLICATIONS

This is a continuation-in-part of application Ser. No. 08/161,996 filed Dec. 2, 1993 (now abandoned) which is a continuation of application Ser. No. 07/934,990, filed Aug. 25, 1992 (now abandoned).

BACKGROUND OF THE INVENTION

1. Field of the Invention

The present invention is directed to a rolling mill train for fabricating a hot rolled wide strip.

2. Description of the Prior Art

Hot rolling wide band trains typically comprise a break-down train including several roll stands and a finishing train. A rough slab of approximately 200 to 300 mm thickness is rolled in the break-down train in several passes to an intermediate thickness of 25 to 60 mm. Such structures require however, at the very least, a reversing stand. After the last pass in the break-down train, the strip is conducted over a roller table to the finishing train where it passes through cropping shears and a high pressure descaling. When head of the strip is in the cropping shears, approximately the same temperature exists across the entire length of the pre-strip. After the leading pass in the first stand, the rolling temperature in the first stand drops continuously because of radiation and convection to the surroundings. With conventional coil weights of, for instance, 20 kg/mm of coil width, the temperature drop at the strip end amounts already to approximately 150° degrees C.

If the finishing train were to be operated at constant speed, the lower temperature level would also be evident in ensuing stands of the finishing train. Finally the finish-rolling temperature governing the technological properties of the strip would noticeably drop from the strip beginning toward the strip end in the last stand.

To avoid such drawbacks, the speed of the finishing train is continuously increased from the band beginning to the band end. The continuously increasing deformation energy at all stands entails a reheating of the strip, which with correct selection of the acceleration rate, results in a constant rolling temperature in the last stand.

This method however, has several disadvantages. The increased deformation velocities and the temperature drop in the front stands causes a noticeable rise of the rolling forces and rolling moments across the strip length. The resulting changes in stand elongation and bending of the sets of rolls must be compensated by expensive control and regulation mechanism. The quantity of heat to be removed in the cooling path increases continuously with increasing velocity. Additional cooling zones must be added as a function of the velocity, wherein irregularities of the coil or reel temperature attained are unavoidable. Finally, a uniform cooling of the strip across the length of the strip with constant cooling velocities becomes impossible.

It is therefore an object of the present invention to provide a rolling mill train for the manufacture of the hot rolled wide strip in which the rolling speed of the band in the finishing train remains constant, without the rolling temperatures in separate stands of the finishing train being changed.

Another object of the invention is to provide a rolling mill train for the manufacture of hot rolled wide strip which provide uniform cooling of the strip along its entire length.

SUMMARY OF THE INVENTION

These and other objects of the invention, which will become apparent hereinafter, are achieved by providing a rolling mill train for the manufacture of hot rolled wide strip including a break-down train of one or several stands, a multi-stand finishing train, with a high pressure descaling and cropping shears provided upstream of the finishing train, and a roller hearth furnace which is provided between the last stand of the break-down train and the cropping shears and which insures adjustment and maintenance of a constant temperature along the entire strip length as it passes from the furnace to the inlet of the first stand of the finishing train.

A constant temperature in a rolled pre-strip along its entire length is achieved by holding the pre-strip in the roller hearth furnace for a predetermined period of time until a uniform predetermined constant temperature is achieved along the entire length and across the entire width of the pre-strip. Usually, this is achieved by maintaining a constant furnace temperature in the furnace space.

An alternative method of providing a constant temperature along and across the pre-strip consists in continuously measuring the pre-strip temperature along the entire pre-strip length at the entrance of the roller hearth furnace, and controlling the furnace burner, based on the taken measurement, so that each section of the pre-strip is heated, as it passes through the furnace, to the predetermined temperature. As a result, the pre-strip would have one and the same temperature as it leaves the furnace. Usually, dependent on the pre-strip material and thickness, the exit temperature of the pre-strip varies between 850°÷1250° C. The temperature tolerance range is about ±10° C.

BRIEF DESCRIPTION OF THE DRAWINGS

A single FIGURE of the drawings shows schematically a rolling mill train according to the present invention.

DETAILED DESCRIPTION OF THE PREFERRED EMBODIMENT

The invention will be better understood from the following detailed description of the preferred embodiment in connection with the drawings which shows a roller hearth furnace 5 located downstream of the last stand of the break-down train 1 and upstream of cropping shears 4 which are provided upstream of high speed descaling means 3. The furnace 5 equalizes the temperature of the strip 7 coming from the break-down train 1 along the entire strip length and keeps it constant. The strip 7 leaves the roller hearth furnace 5 at this temperature with a velocity which remains constant. An induction heating section 6 may be disposed upstream of the roller hearth furnace 5.

Since the travel time of the strip from the end of the roller hearth furnace 5 to the rolling gap of the first stand of the finishing train is the same at a constant velocity for all subsequently entering portions of the strip 7, the rolling temperature of each portion of the strip 7 entering the first stand of the finishing train will be the same. The velocity of the strip leaving the roller hearth furnace varies in the range of 0.1m/s ÷1.5m/s. Lastly, any desired final rolling temperature in the first stand of the finishing train can be set up, with the rolling velocity being constant, as a function of the furnace temperature and the strip thickness.

As it has already been discussed above, because the travel time of each segment of the strip from the exit of the roller hearth furnace to the inlet of the first stand of the finishing train is the same, each segment arrives at the first stand inlet at the same temperature. With the strip velocity in the finishing train being constant, the temperature of the strip uniformly decreases from the first stand of the finishing train to the last stand of the finishing train, and with the rolling temperature in each stand of the finishing train remaining constant.

By providing a roller hearth furnace which insures that both the strip head or beginning and the strip end or tail leaves the furnace at the same temperature, by displacing the strip from the furnace exit to the finishing train at one and the same velocity, and by operating the finishing train with a constact velocity, it is achieved that the strip, upon leaving the finishing train, has one and the same temperature, within allowable tolerances, of course, along its entire length. As a result, the technological properties of the strip remain unchange along the entire length of the strip. Generally, the finishing train is operated at a velocity which varies in a range of 1.5 m/s ÷20 m/s dependent on strip parameters, but remains constanct for each strip. The temperature of the strip leaving the finishing train varies from 700° tro 930° C., remaining constant for each strip.

Further when the finishing train 2 is operated in the proposed manner, constant rolling forces and rolling moments result across the entire strip length. The portions of the cooling path 8, upstream of the reel 9, which have to be activated for obtaining specific coiler temperatures also remain constant and constant cooling velocities across the entire strip length are assured. The coiler (or reel) temperature can be kept constant within tight tolerances.

Another advantage of such construction is the extensive elimination of the so-called skid marks in the pre-strip. Skid marks are cooler spots existing at regular spacings in the pre-strip because of contact of the rough slab with the water-cooled contact rails in the slab furnace. The skid marks are largely eliminated during passage through the heated roller hearth furnace 5, so that a noticeable decrease of the known disturbances in the rolling force is achieved and, with it, resulting variations in the thickness of the strip to be rolled are reduced.

Another advantage of the present invention is the reduction of the driving power of the finishing train 2 since the energy required for acceleration is not necessary. The design of the cooling path 8 is considerably simplified. Cooling at constant velocities makes operation at predetermined temperature curves possible for obtaining specific technical properties which can be observed for every point of the strip across the entire strip length. This opens new possibilities for optimizing thermomechanical effects.

While the preferred embodiment of the invention has been described in detail, modifications and adaptations thereto may be made without departing from the spirit and scope of the invention as defined in the following claims.

What is claimed is:

1. A method of producing a hot rolled wide strip having a predetermined length, comprising the steps of:

providing a rolling mill train including a break-down train having at least one stand, a roller hearth furnace arranged downstream of the break-down train, cropping shears arranged downstream of the roller hearth furnace, high pressure descaling means arranged downstream of the cropping shears, a finishing train having a plurality of stands arranged downstream of the descaling means, and a cooling path arranged downstream of the finishing train;

rolling the strip in the break-down train; thereafter, equalizing temperature of the hot rolled wide strip leaving the break-down train along an entire length of the strip to a predetermined constant temperature in the roller heath furnace;

delivering the strip from the roller hearth furnace through the cropping shears and the descaling measn to an inlet of a first stand of the finishing train at a same constant velocity;

operating the finishing train at a constant rolling velocity, whereby the entire length of the strip leaves the finishing train ay a constant temperature between about 700° C. to about 930° C.; and cooling the hot rolled wide strip, which exits the finishing train, at a constant cooling speed to a constant reeling temperature in a cooling path.

2. A method according to claim 1, further comprising the step of heating the hot rolled wide strip leaving the break-down train in an inducting heating section provided upstream of the roller hearth furnace.

3. A method according to claim 1, wherein the equalizing temperature step includes heating the roller hearth furnace by one of oil and gas.

4. A method according to claim 1, wherein the step of rolling the strip in the break-down train includes rolling the strip to an intermediate thickness from about 25 mm to about 60 mm.

5. A method according to claim 1, wherein velocity of the strip leaving the roller hearth furnace varies in a range from about 0.1 m/sec to about 1.5 m/sec.

* * * * *

UNITED STATES PATENT AND TRADEMARK OFFICE

CERTIFICATE OF CORRECTION

PATENT NO. : 5,842,367

DATED : December 1, 1998

INVENTOR(S) : Olfgang Rohde

It is certified that error appears in the above-identified patent and that said Letters Patent is hereby corrected as shown below:

On the title page: Item [73] should read :

[73] Assignee: SMS Schloemann-Siemag Aktiengesellschaft, Düsseldorf, Germany Signed and Sealed this Thirtieth Day of March, 1999

*Attest:*

*Attesting Officer*

Q. TODD DICKINSON

*Acting Commissioner of Patents and Trademarks*